US011506381B2

(12) United States Patent
Zink et al.

(10) Patent No.: US 11,506,381 B2
(45) Date of Patent: Nov. 22, 2022

(54) PLUG-RESISTANT BURNER TIP AND METHOD

(71) Applicant: ZEECO, INC., Broken Arrow, OK (US)

(72) Inventors: Darton J. Zink, Tulsa, OK (US); Rex K. Isaacs, Collinsville, OK (US); John Petersen, Pawnee, OK (US); Tim Kirk, Morris, OK (US); Austin White, Tulsa, OK (US)

(73) Assignee: ZEECO, INC., Broken Arrow, OK (US)

( * ) Notice: Subject to any disclaimer, the term of this patent is extended or adjusted under 35 U.S.C. 154(b) by 334 days.

(21) Appl. No.: 16/875,194

(22) Filed: May 15, 2020

(65) Prior Publication Data

US 2021/0356122 A1 Nov. 18, 2021

(51) Int. Cl.

| | |
|---|---|
| ***F23D 14/10*** | (2006.01) |
| ***F23D 14/70*** | (2006.01) |
| ***F23L 9/00*** | (2006.01) |
| ***F23N 3/00*** | (2006.01) |
| ***F23K 5/00*** | (2006.01) |

(52) U.S. Cl.

CPC ..... *F23D 14/105* (2013.01); *F23D 14/70* (2013.01); *F23K 5/005* (2013.01); *F23L 9/00* (2013.01); *F23N 3/007* (2013.01); *F23D 2209/20* (2013.01); *F23N 2237/32* (2020.01)

(58) Field of Classification Search

CPC ..... F23D 14/06; F23D 14/105; F23D 14/70; F23D 2209/20; F23K 5/005; F23K 5/007; F23L 9/00; F23N 2237/32; F23N 3/007

USPC ..... 431/23

See application file for complete search history.

(56) References Cited

U.S. PATENT DOCUMENTS

| | | | | | |
|---|---|---|---|---|---|
| 1,837,105 | A | | 12/1931 | Brennan | |
| 2,220,247 | A | | 11/1940 | Kochendorfer | |
| 2,573,502 | A | | 10/1951 | Smith, Jr. | |
| 2,817,696 | A | | 12/1957 | Beck | |
| 3,063,494 | A | | 11/1962 | Meyer | |
| 3,289,731 | A | | 12/1966 | Gerber | |
| 3,343,418 | A | * | 9/1967 | Branche | F23Q 9/04 337/394 |
| 3,439,997 | A | * | 4/1969 | Hancock | F23D 14/04 239/499 |
| 3,548,592 | A | * | 12/1970 | Hopkins | F23R 3/283 60/39.827 |

(Continued)

FOREIGN PATENT DOCUMENTS

GB 2101734 1/1983

OTHER PUBLICATIONS

Platvoet, et al.; Process Burners 101; AlChE; Aug. 2013; pp. 35-39; US.

(Continued)

*Primary Examiner* — Avinash A Savani
(74) *Attorney, Agent, or Firm* — Dennis D. Brown; Brown Patent Law PLLC

(57) ABSTRACT

A burner tip apparatus which is resistant to plugging, and a staged air method of operation which reduces the peak temperature of the flame of the burner tip to provide low levels of $NO_x$ and other emissions. The burner tip can be used as an auxiliary burner tip for stabilizing a main burner flame, or for other purposes.

19 Claims, 2 Drawing Sheets

(56) References Cited

U.S. PATENT DOCUMENTS

| | | | | |
|---|---|---|---|---|
| 4,473,349 | A * | 9/1984 | Kumatsu | F23M 9/06 431/172 |
| 5,984,673 | A * | 11/1999 | Bossetti | F27D 99/0033 432/175 |
| 6,379,146 | B1 | 4/2002 | Zink et al. | |
| 6,499,990 | B1 | 12/2002 | Zink et al. | |
| 6,626,661 | B1 | 9/2003 | Zink et al. | |
| 6,675,581 | B1 * | 1/2004 | Stuttaford | F23R 3/286 60/737 |
| 7,670,135 | B1 | 3/2010 | Zink et al. | |
| 9,222,668 | B2 | 12/2015 | Zink et al. | |
| 2003/0175642 | A1 | 9/2003 | Stephens | |
| 2005/0252996 | A1 * | 11/2005 | Nozaki | F02M 21/0275 239/533.3 |
| 2009/0294421 | A1 * | 12/2009 | Hu | F02M 61/1806 29/890.132 |
| 2017/0336068 | A1 | 11/2017 | Martin | |
| 2021/0080101 | A1 | 3/2021 | Zink et al. | |

OTHER PUBLICATIONS

CLSF Free-Jet Round Flame Combination Burner; Dec. 16, 2019; Zeeco; US.

PCT/US2021/031787—International Preliminary Report With International Search Report and Written Opinion; dated Sep. 20, 2021.

* cited by examiner

PLUG-RESISTANT BURNER TIP AND METHOD

FIELD OF THE INVENTION

The present invention relates to burner tip apparatuses and methods which are resistant to plugging, while also producing low levels of $NO_x$ and other emissions. More particularly, but not by way of limitation, the present invention relates to burner tips of this type which can be used as auxiliary tips for burner flame stabilization.

BACKGROUND OF THE INVENTION

Industrial burners are commonly used in process heaters, boilers, furnaces, incinerators, and other fired-heating systems to produce heat for petroleum refining, chemical production, petrochemical production, and other large-scale industrial processes.

The processing units in today's refineries, chemical plants, and other facilities must be capable of operating for increasingly longer periods of time without the need to shut down for major repairs and maintenance. In fact, the maintenance cycles in many refineries and other facilities are now up to four years, or longer. Consequently, the continued operation of burners and other critical equipment for very long periods of time is also becoming increasingly important.

One of the main causes of down time for industrial burners occurs when the fuel gas ports of the burner tip(s) become plugged with debris or residue. The plugging of the fuel gas ports can lead to reduced or completely restricted fuel gas flow. Moreover, if such plugging occurs in a burner tip which is being used to maintain the stability of the burner flame, the localized temperature at the stability point can be reduced until the stability of the flame can no longer be maintained and the flame is lost. When a loss of flame occurs in one or more burners of a multiple burner heating system, significant safety concerns can arise, including the risk of an explosion.

An auxiliary burner tip is a gas tip which is used to enhance the stability of the main flame of a burner, particularly during upset conditions. Examples of upset conditions which can cause the burner flame to become unstable include but are not limited to: (a) a reduction in the air flow to the burner to a sub-stoichiometric level, (b) a loss of temperature in the fired-heating system to a level below the minimum temperature required for igniting the fuel, or (c) the occurrence of pressure excursions in the fired-heating system.

Unfortunately, the auxiliary tips currently used in the art for purposes of flame stabilization are particularly susceptible to plugging. The fuel gas ports of these auxiliary tips must be very small, typically 1/16 inch in diameter (i.e., a port flow area of only 0.0031 $in^2$). As a result, the auxiliary tips currently used in the art are prone to plugging, even after filtration.

Consequently, a need exists for an improved burner tip which is resistant to plugging and can be used as an auxiliary tip for flame stability, or for other purposes. The improved plug-resistant burner tip will preferably also produce very low levels of $NO_x$ and other emissions which are comparable to, or better than, the emissions levels of the auxiliary tips currently used in the art.

SUMMARY OF THE INVENTION

The present invention provides a burner tip apparatus, and method of operation, which satisfy the needs and alleviate the problems discussed above. The inventive burner tip is highly resistant to plugging and, in addition to other uses, is particularly well suited for use as an auxiliary tip for maintaining the stability of a main burner flame. The inventive burner tip and method of operation also use a staged air combustion regime which reduces the production of $NO_x$ and other emissions to very low levels. The low emissions levels produced by the inventive burner tip and method are comparable to, or better than, the emissions levels produced by the auxiliary tips currently used in the art, which require the use of very small fuel discharge ports and are prone to plugging.

In one aspect, there is provided a burner tip apparatus which preferably comprises: (a) a shield housing having a mixing chamber therein and a longitudinally extending outer wall which surrounds the mixing chamber; (b) a fuel gas spud having, at a forward end of the fuel gas spud, a fuel port positioned to discharge a gas fuel into a rearward longitudinal end of the mixing chamber; (c) a lateral base wall of the shield housing at a rearward longitudinal end of the mixing chamber, the lateral base wall having a central opening provided therethrough; (d) a lateral flame stabilization ring of the shield housing at a forward longitudinal end of the mixing chamber, the flame stabilization ring having a discharge opening for the mixing chamber provided therethrough; and (e) a flame diverter on a forward longitudinal end of the shield housing.

In another aspect, there is provided a method of operating a burner tip apparatus. The method preferably comprises the steps of: (a) discharging a gas fuel into a rearward longitudinal end of a mixing chamber of the burner tip apparatus, the mixing chamber having a lateral base wall at the rearward longitudinal end of the mixing chamber and the lateral base wall having at least a central opening formed therethrough; (h) using the flow momentum of the gas fuel discharged in step (a) to draw a sub-stoichiometric amount of air, or other oxygen-containing gas, through at least the central opening of the lateral base wall to form a sub-stoichiometric, fuel rich mixture of the air, or other oxygen-containing gas, and the gas fuel in the mixing chamber; (c) discharging the sub-stoichiometric mixture of the air, or other oxygen-containing gas, and the gas fuel through a stabilization ring at a forward longitudinal end of the mixing chamber to form a reduced pressure area outside of the forward longitudinal end of the mixing chamber which stabilizes the flame of the burner tip apparatus, the flame having an initial sub-stoichiometric combustion region in which a first portion of the gas fuel of the sub-stoichiometric mixture of the air, or other oxygen-containing gas, and the gas fuel is burned; and (d) diverting the flame laterally outward into a stream or body of air or other oxygen-containing gas to form a fuel lean combustion region in which a remaining portion of the gas fuel is combusted.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
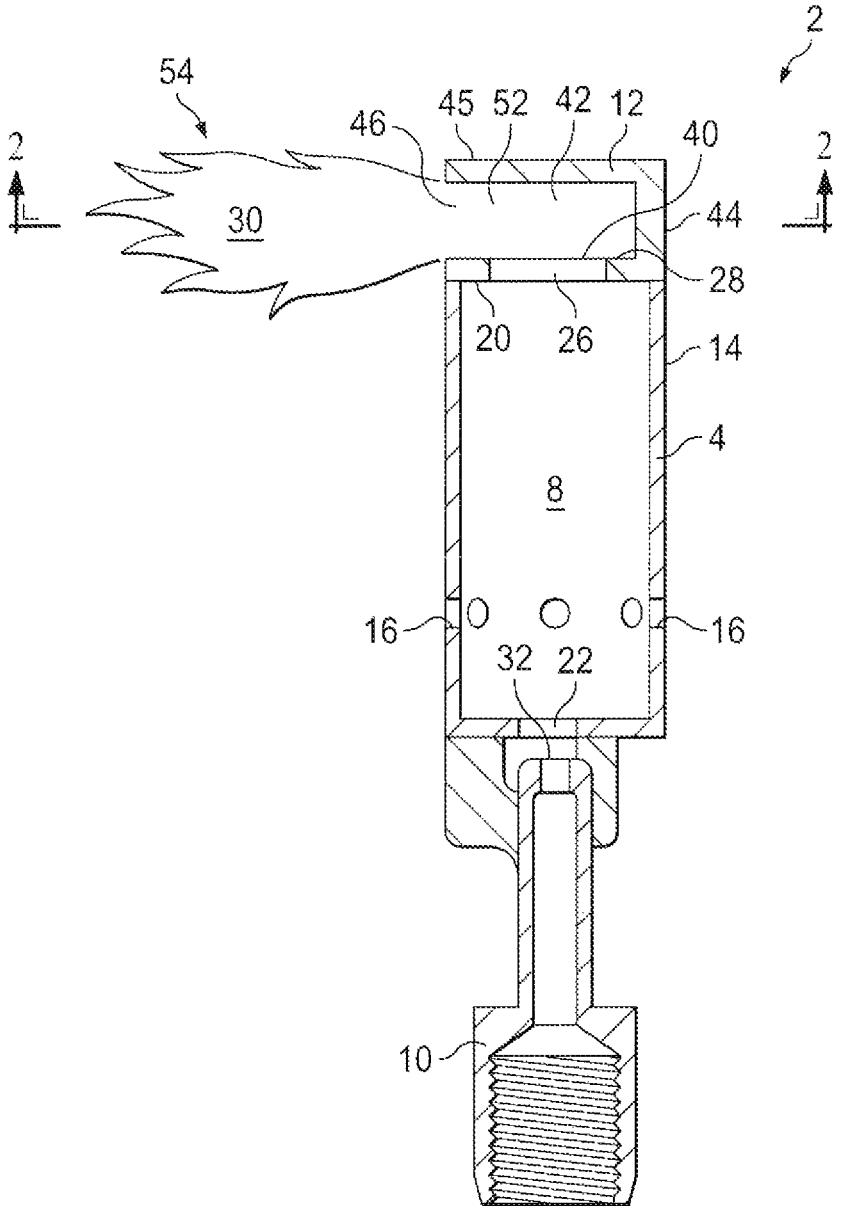
FIG. 1 is a cutaway elevational view of an embodiment 2 of the burner tip apparatus provided by the present invention.
Figure 2:
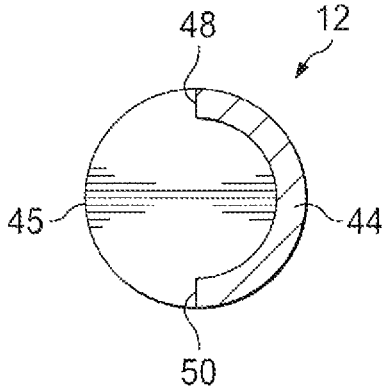
FIG. 2 is a cutaway view of a flame diverter 12 of the inventive burner tip apparatus 2 as seen from the perspective 2-2 shown in FIG. 1.
Figure 3:
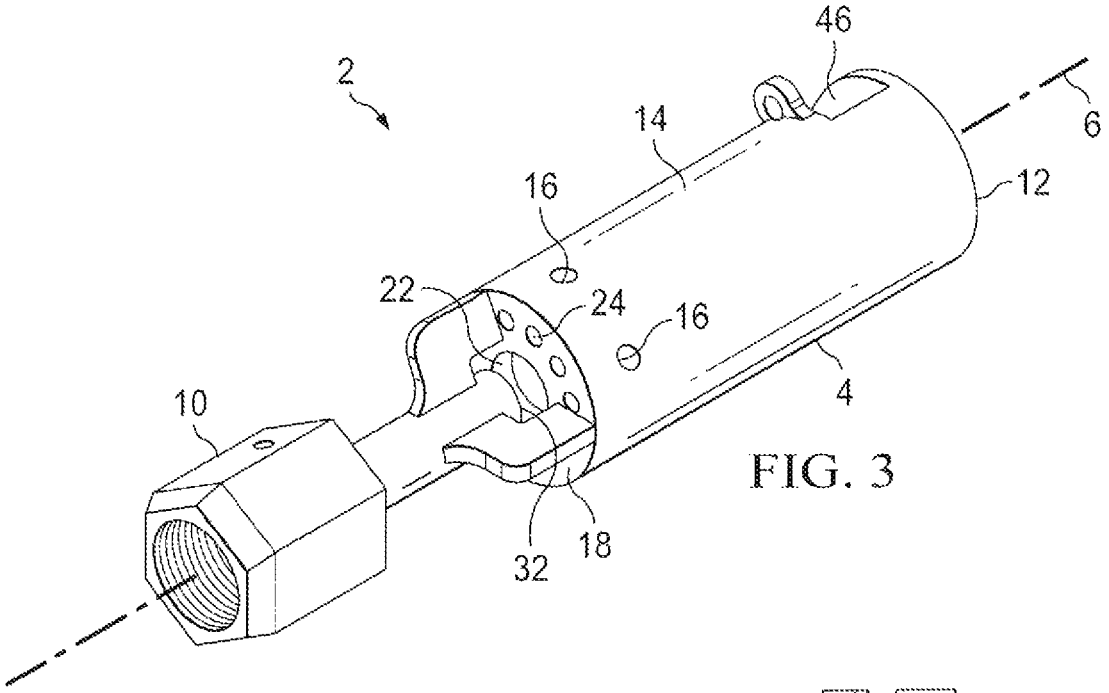
FIG. 3 is a perspective view of the inventive burner tip apparatus 2.

An embodiment 2 of the inventive burner tip apparatus is illustrated in FIGS. 1-4. The inventive burner tip 2 preferably comprises: a tip shield housing 4 having a longitudinal axis 6; a mixing chamber 8 contained within the shield housing 4; a gas fuel spud 10 positioned to discharge a gas fuel into the rearward longitudinal end of the mixing chamber 8; and a flame diverter 12 on the forward longitudinal end of the shield housing 4.

The tip shield housing 4 preferably comprises a longitudinally extending outer wall 14 which surrounds the longitudinal axis 6 and the mixing chamber 8. The outer wall 14 is preferably cylindrical but can alternatively have a square, oval, or other cross-sectional shape. A series of small openings 16 is provided around and through a rearward portion of the outer wall 14 to serve as contingency relief openings for gas expansion in the event that combustion occurs within the shield housing 4 itself. This may happen, for example, when burning hydrogen or similar fuels which have high flame speeds and require less oxygen.

The tip shield housing 4 preferably further comprises (i) a lateral base wall 18 at the rearward longitudinal end of mixing chamber 8 and (ii) a lateral flame stabilization ring 20 at the forward longitudinal end of the mixing chamber 8.

The lateral base wall 18 at the rearward end of the mixing chamber 8 has a central opening 22 provided therethrough. As the gas fuel is discharged into the rearward end of the mixing chamber 8 by the gas fuel spud 10, the momentum of the gas fuel stream draws air or other oxygen-containing gas into the mixing chamber 8 through the central base opening 22. In addition, the momentum of the gas fuel preferably also draws air or other oxygen-containing gas into the mixing chamber 8 through a plurality of openings 24 which are formed through the base wall 18 of the shield housing 4 around the central base opening 22. The surrounding openings 24 provided in the base wall 18 are preferably smaller that the central base opening 22.

The central base opening 22 and the surrounding base openings 24 of the shield housing 4 are preferably sized such that the total amount of air or other oxygen-containing gas which is drawn through the base openings 22 and 24 for mixing with the gas fuel is a sub-stoichiometric amount, i.e., an amount which is not sufficient for burning all of the gas fuel which is discharged into the mixing chamber 8 by the gas fuel spud 10.

The lateral flame stabilization ring 20 at the forward longitudinal end of the mixing chamber 8 has a central discharge opening 26 provided therethrough for discharging the sub-stoichiometric mixture of air, or other oxygen-containing gas, and gas fuel from the forward end of the mixing chamber 8. The diameter (or other dimension of the discharge opening 26 if the opening 26 is noncircular) and the corresponding area of the discharge opening 26 of the flame stabilization ring 20 are smaller than the cross-sectional diameter (or other cross-sectional dimension of the mixing chamber 8 if the chamber 8 is noncylindrical) and cross-sectional area of the mixing chamber 8 so that the flow of the sub-stoichiometric gas mixture from the mixing chamber 8 through the flame stabilization ring 20 creates a reduced pressure area 28 on or near the stabilization ring 20 outside of the forward end of the mixing chamber 8. The reduced pressure area 28 assists in holding and otherwise stabilizing the flame 30 produce by the inventive burner tip 2 so that the necessary time, temperature, and turbulence required to sustain combustion are provided.

The gas fuel spud 10 has a fuel discharge port 32 in the forward end thereof for discharging the gas fuel into the rearward longitudinal end of the mixing chamber 8. The fuel discharge port 32 of the spud 10 is preferably positioned rearwardly of the base wall 18 of the shield housing 4 so that the spud 10 discharges the gas fuel forwardly through the central opening 22 of the base wall 18. The fuel discharge port 32 can be formed directly in the forward end of the gas fuel spud 10 or can be formed in an orifice plug which is placed in the forward end of the spud 10.

To prevent plugging of the fuel spud discharge port 32, the port 32 is (a) preferably a large opening having a diameter of at least $1/8^{th}$ inch (or equivalent dimension if noncircular) which corresponds to a flow area of the discharge port 32 of at least 0.012 $inch^2$ and (b) more preferably at least ¼ inch (or equivalent dimension if noncircular) which corresponds to a flow area of the discharge port 32 of at least 0.049 $inch^2$.

Figure 4:
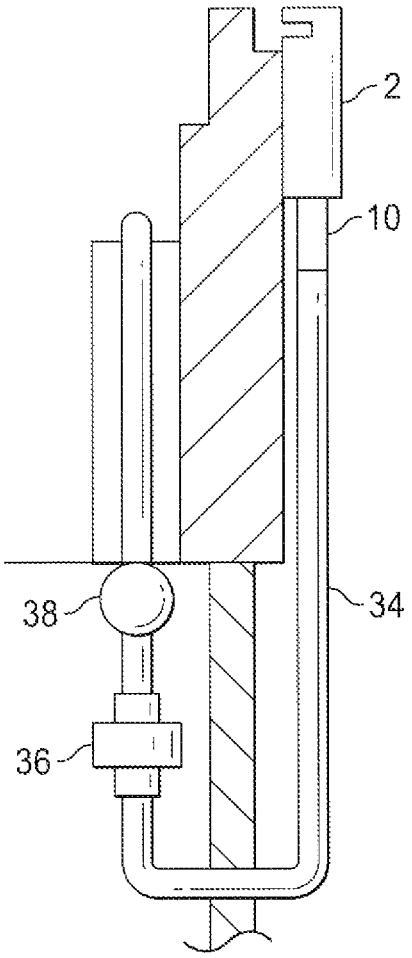
FIG. 4 schematically illustrates the inventive burner tip apparatus 2 connected to a fuel line 34 having an orifice union 36 installed therein.

In addition, as depicted in FIG. 4, the gas fuel spud 10 is connected to a gas fuel supply line or riser 34 having an orifice union 36 therein which contains a flow orifice. The flow area of the flow orifice in the orifice union 36 (a) is preferably at least 0.0068 $inch^2$ (which is equivalent to a circular orifice diameter of at least $3/32^{nd}$ inch) and (b) is more preferably at least 0.012 $inch^2$ (which is equivalent to a circular orifice diameter of at least ⅛ inch).

However, the flow area of the flow orifice is also preferably less than the size of the fuel spud discharge port 32. In the event that the system contains any debris which would be of sufficient size to plug even the large discharge port 32 of the gas fuel spud 10, the debris will be stopped by the flow orifice in the orifice union 36, which will be positioned outside of the fired-heating system and can be easily cleaned. The flow orifice in the orifice union 36 can also be used to meter the rate of flow of the gas fuel to the inventive burner tip 2 from the external fuel supply manifold 38.

The flame diverter 12 on the forward longitudinal end of the shield housing 4 preferably comprises: a rearward opening 40; an interior flame space 42; a longitudinally extending side wall 44 which extends partially around the interior flame space 42; an end wall 45 at the forward longitudinal end of the side wall 44 of the flame diverter 12; and a lateral side opening 46. The end wall 45 is preferably a solid circular end wall which extends laterally over and covers the interior flame space 42. The longitudinally extending side wall 44 of the flame diverter 12 has a semicircular lateral cross-sectional shape which extends from a first are end point 48 to a second arc end point 50. The semicircular cross-sectional shape of the longitudinally extending side wall 44 is preferably an arc in the range of from 120° to 270° which extends from the first arc end point 48 to the second arc end point 50 and is more preferably an arc of about 180°.

The lateral side opening 46 of the flame diverter 12 preferably (a) extends from the first arc end point 48 to the second arc end point 50 of the side wall 44 in the lateral cross-sectional plane and (b) extends longitudinally from the lateral flame stabilization ring 20 to the end wall 45 of the flame diverter 12. The lateral side opening 46 is preferably oriented to discharge the flame 30 of the inventive burner tip 2 laterally outward at an angle which is in the range of from 60° to 120°, more preferable about 90°, with respect to the longitudinal axis 6 of the tip shield housing 4.

Among other uses, the diversion of the tip flame 30 by the flame diverter 12 is advantageous for directing the flame 30 of the inventive tip 2 onto a ledge, shoulder, or end of a burner wall, or onto any other stability point of a burner, for maintaining the stability of the main burner flame. Moreover, the diversion of the tip flame 30 by the flame diverter 12 is advantageously used to create a staged air operating regime which reduces the $NO_x$ and other emissions produced by the inventive burner tip apparatus 2.

In the staged air operating regime of the inventive burner tip 2, the sub-stoichiometric, fuel rich, mixture of air (or other oxygen-containing gas) and gas fuel flowing out of the forward end of the mixing chamber 8 begins combustion in a sub-stoichiometric combustion region 52, which includes the interior flame space 42 of the flame diverter 12. Next, the flame 30 proceeding from the interior flame space 42 of the flame diverter 12 is diverted laterally into a flow or body of air, or other oxygen-containing gas, outside of the inventive burner tip 2. The diversion of the flame 30 into the exterior air, or other oxygen-containing gas, creates a fuel lean combustion region 54, outside of the inventive tip 2, in which the remaining portion of the gas fuel which was not combusted in the sub-stoichiometric combustion zone 52 is burned.

In the inventive method of operating the burner tip apparatus 2, a gas fuel flows to the gas fuel spud 10 via the fuel line 34 and the orifice union 36 and is discharged forwardly from the discharge port 32 of the spud 10 through the central base opening 22 of the shield housing 4. As the gas fuel flows through the central base opening 22 and into the rearward end of the mixing chamber 8, the momentum of the gas fuel draws external air or other oxygen-containing gas into the rearward end of the mixing chamber 8 via the central base opening 22 and the surrounding base openings 24. The base openings 22 and 24 are sized such that the amount of air, or other oxygen-containing gas, drawn through the base openings 22 and 24 is not sufficient to combust all of the gas fuel and thus forms a sub-stoichiometric mixture with the gas fuel in the mixing chamber 8.

The sub-stoichiometric mixture of the air, or other oxygen-containing gas, and the gas fuel formed in the mixing chamber 8 is then discharged, through the flame stabilization ring 20 at the forward longitudinal end of the mixing chamber 8, into the interior flame space 42 of the flame diverter 12. This creates a reduced pressure area 28 outside of the forward end of the mixing chamber 8 for stabilizing the flame 30 of the inventive burner tip 2. Because of the sub-stoichiometric nature of the mixture of air, or other oxygen-containing gas, and fuel discharged from the mixing chamber 8 into the flow diverter 12, the flame 30 of the burner tip 2 begins in an initial sub-stoichiometric, fuel rich, combustion region 52 which includes the interior flame space 42 of the flame diverter 12.

Next, the flame diverter 12 diverts the flame 30 of the burner tip 2 laterally outward into an external flow or body of air, or other oxygen-containing gas, outside of the burner tip apparatus 2. This creates an external fuel lean combustion region 54 in which the remaining gas fuel which was not combusted in the initial sub-stoichiometric combustion region 52 is burned.

The staged air operation provided by combusting a first portion of the fuel in the sub-stoichiometric flame region 52 followed by combustion the remainder of the fuel in the fuel lean flame region 54 reduces the peak temperature of the burner tip flame 30 in in both regions and thereby reduces the levels of $NO_x$ and other emissions produced by the inventive burner tip 2.

Although the inventive burner tip apparatus 2 is illustrated in the drawings as being in a vertical orientation, it will be understood that the burner tip apparatus 2 can alternatively be oriented downwardly, horizontally, or at any other desired angle. In addition, although various elements and features of the inventive burner tip apparatus 2 are shown and have been described as having cylindrical or circular shapes, it will be understood that these elements and features can alternatively be square or oval in shape, or can be of any other shape desired.

Depending, for example, on the size of the burner in which the inventive burner tip 2 is used, the dimensions of the burner tip 2 can range from small to extremely large. For most cases, the overall size of the inventive burner tip 2 will be such that: the total longitudinal length of the shield housing 4 and the flame diverter 12 will be in the range of from about 4 to about 6 inches; the diameter of the shield housing 4 will be in the range of from about 1 to about 4 inches; the longitudinal height of the lateral side opening 46 of the flame diverter 12 will be in the range of from about 1/32 to about 1/2 inch; the diameter of the central base opening 22 will be in the range of from about 5/8 to about 1 inch; and the diameter of each of the surrounding base holes 24 will be in the range of from about 1/8 to about t inch.

Thus, the present invention is well adapted to carry out the objectives and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. A burner tip apparatus comprising:

a shield housing having a mixing chamber therein and a longitudinally extending outer wall which surrounds the mixing chamber:

a gas fuel spud having a fuel port which discharges a gas fuel into a rearward longitudinal end of the mixing chamber;

a lateral base wall of the shield housing at a rearward longitudinal end of the mixing chamber, the lateral base wall having one or more openings provided therethrough through which a flow of air or other oxygen-containing gas is drawn by a momentum of the gas fuel discharged by the fuel port of the gas fuel spud, the one or more openings comprising at least a central opening, and the one or more openings having a total flow area which limits the flow of air or other oxygen-containing gas to a sub-stoichiometric amount which mixes with the gas fuel in the mixing chamber to form a sub-stoichiometric fuel-rich mixture;

a lateral flame stabilization ring of the shield housing at a forward longitudinal end of the mixing chamber, the flame stabilization ring having a discharge opening for the mixing chamber; and a flame diverter on a forward longitudinal end of the shield housing, the flame diverter comprising an interior sub-stoichiometric combustion chamber into which the sub-stoichiometric fuel-rich mixture is discharged from the mixing chamber through the discharge opening of the flame stabilization ring and in which a portion of the gas fuel is combusted.

2. The burner tip apparatus of claim 1 further comprising the one or more openings provided through the lateral base wall of the shield housing including a plurality of outer openings formed through the lateral base wall of the shield housing around the central opening of the lateral base wall.

3. The burner tip apparatus of claim 2 wherein the outer openings formed through the lateral base wall of the shield housing are smaller than the central opening of the lateral base wall.

4. The burner tip apparatus of claim 1 wherein the fuel port of the gas fuel spud is positioned rearwardly of the central opening of the lateral base wall of the shield housing and is oriented to discharge a stream of the gas fuel into the mixing chamber through the central opening of the lateral base wall.

5. The burner tip apparatus of claim 1 further comprising a plurality of combustion expansion relief openings formed through the longitudinally extending outer wall of the shield housing in a rearward portion of the mixing chamber.

6. The burner tip apparatus of claim 1 wherein the flame diverter further comprises:

a lateral end wall at a forward longitudinal end of the flame diverter and a lateral side opening.

7. The burner tip apparatus of claim 6 wherein:

the flame diverter further comprises a longitudinally extending side wall;

the longitudinally extending side wall of the flame diverter has a semicircular lateral cross-sectional shape which extends from a first arc end point to a second arc end point; and the lateral side opening of the flame diverter extends from the first arc end point to the second are end point.

8. The burner tip apparatus of claim 7 wherein the semicircular lateral cross-sectional shape of the side wall of the flame diverter is an arc in a range of from 120° to 270° which extends from the first arc end point to the second arc end point.

9. The burner tip apparatus of claim 8 wherein the semicircular lateral cross-sectional shape of the side wall of the flame diverter is an arc of about 180° which extends from the first arc end point to the second arc end point.

10. The burner tip apparatus of claim 8 wherein the lateral end wall of the flame diverter is a solid, circular end wall on a forward end of the longitudinally extending side wall of the flame diverter.

11. The burner tip apparatus of claim 10 wherein the lateral side opening of the flame diverter extends longitudinally from the lateral flame stabilization ring at the forward end of the mixing chamber to the solid, circular end wall of the flame diverter.

12. A method of operating a burner tip apparatus comprising the steps of:

a) discharging a gas fuel into a rearward longitudinal end of a mixing chamber of the burner tip apparatus, the mixing chamber having a lateral base wall at the rearward longitudinal end of the mixing chamber and the lateral base wall having a central opening formed therethrough;

b) using a flow momentum of the gas fuel discharged in step (a) to draw a sub-stoichiometric amount of air, or other oxygen-containing gas, through both the central opening of the lateral base wall and a plurality of outer openings formed through the lateral base wall which surround the central opening to form a sub-stoichiometric, fuel rich mixture of the air, or other oxygen-containing gas, and the gas fuel in the mixing chamber;

c) discharging the sub-stoichiometric mixture of the air, or other oxygen-containing gas, and the gas fuel through a stabilization ring at a forward longitudinal end of the mixing chamber to form a reduced pressure area outside of the forward longitudinal end of the mixing chamber which stabilizes a flame of the burner tip apparatus, the flame having an initial sub-stoichiometric combustion region in which a first portion of the gas fuel of the sub-stoichiometric mixture of the air, or other oxygen-containing gas, and the gas fuel is burned; and d) diverting the flame laterally outward into a stream or body of air or other oxygen-containing gas to form a fuel lean combustion region in which a remaining portion of the gas fuel is combusted.

13. The method of claim 12 wherein the outer openings formed through the lateral base wall are smaller than the central opening of the lateral base wall.

14. A burner tip apparatus comprising:

a shield housing having a mixing chamber therein and a longitudinally extending outer wall which surrounds the mixing chamber;

a gas fuel spud having a fuel port positioned to discharge a gas fuel into a rearward longitudinal end of the mixing chamber;

a lateral base wall of the shield housing at a rearward longitudinal end of the mixing chamber, the lateral base wall having a central opening provided therethrough;

a lateral flame stabilization ring of the shield housing at a forward longitudinal end of the mixing chamber, the flame stabilization ring having a discharge opening for the mixing chamber provided therethrough; and a flame diverter on a forward longitudinal end of the shield housing, the fuel port of the gas fuel spud having a flow area of at least 0.049 $in^2$.

15. The burner tip apparatus of claim 14 further comprising:

a fuel supply line extending to the gas fuel spud;

an orifice union in the fuel supply line;

a flow orifice in the orifice union;

the flow orifice has a flow area of at least 0.012 $in^2$; and the flow area of the fuel port of the gas fuel spud is larger than the flow area of the flow orifice.

16. A method of operating a burner tip apparatus comprising the steps of:

a) discharging a gas fuel into a rearward longitudinal end of a mixing chamber of the burner tip apparatus, the mixing chamber having a lateral base wall at the rearward longitudinal end of the mixing chamber and the lateral base wall having at least a central opening formed therethrough;

b) using a flow momentum of the gas fuel discharged in step (a) to draw a sub-stoichiometric amount of air, or other oxygen-containing gas, through at least the central opening of the lateral base wall to form a sub-stoichiometric, fuel rich mixture of the air, or other oxygen-containing gas, and the gas fuel in the mixing chamber;

c) discharging the sub-stoichiometric mixture of the air, or other oxygen-containing gas, and the gas fuel through a stabilization ring at a forward longitudinal end of the mixing chamber to form a reduced pressure area outside of the forward longitudinal end of the mixing chamber which stabilizes a flame of the burner tip apparatus, the flame having an initial sub-stoichiometric combustion region in which a first portion of the gas fuel of the sub-stoichiometric mixture of the air, or other oxygen-containing gas, and the gas fuel is burned; and d) diverting the flame laterally outward, using a flame diverter, into a stream or body of air or other oxygen-containing gas to form a fuel lean combustion region in which a remaining portion of the gas fuel is combusted, the flame diverter comprising a lateral end wall at a forward end of a longitudinally extending side wall and a lateral side opening, the longitudinally extending side wall of the flame diverter having a semicircular lateral cross-sectional shape forming an arc in a range of from 120° to 270° which extends from a first arc end point to a second arc end point, and the lateral side opening of the flame diverter extending from the first are end point to the second are end point.

17. The method of claim 16 wherein the lateral side opening of the flame diverter also extends longitudinally from the stabilization ring at the forward longitudinal end of the mixing chamber to the lateral end wall of the flame diverter.

18. A method of operating a burner tip apparatus comprising the steps of:

a) discharging a gas fuel into a rearward longitudinal end of a mixing chamber of the burner tip apparatus, the mixing chamber having a lateral base wall at the rearward longitudinal end of the mixing chamber and the lateral base wall having at least a central opening formed therethrough;

b) using a flow momentum of the gas fuel discharged in step (a) to draw a sub-stoichiometric amount of air, or other oxygen-containing gas, through at least the central opening of the lateral base wall to form a sub-stoichiometric, fuel rich mixture of the air, or other oxygen-containing gas, and the gas fuel in the mixing chamber;

c) discharging the sub-stoichiometric mixture of the air, or other oxygen-containing gas, and the gas fuel through a stabilization ring at a forward longitudinal end of the mixing chamber to form a reduced pressure area outside of the forward longitudinal end of the mixing chamber which stabilizes a flame of the burner tip apparatus, the flame having an initial sub-stoichiometric combustion region in which a first portion of the gas fuel of the sub-stoichiometric mixture of the air, or other oxygen-containing gas, and the gas fuel is burned; and d) diverting the flame laterally outward into a stream or body of air or other oxygen-containing gas to form a fuel lean combustion region in which a remaining portion of the gas fuel is combusted, the gas fuel being discharged in step (a) from a fuel port having a flow area of at least 0.049 $in^2$.

19. The method of claim 18 further comprising the step, prior to step (a), of delivering the gas fuel through a flow orifice, the flow orifice having a flow area of at least 0.012 $in^2$, and the flow area of the fuel port being larger than the flow area of the flow orifice.

* * * * *